United States Patent [19]

Ohkoshi

[11] Patent Number: 4,754,734

[45] Date of Patent: Jul. 5, 1988

[54] INJECTION QUANTITY INCREASING MECHANISM FOR GOVERNOR IN FUEL INJECTION PUMP AT ENGINE STARTING

[75] Inventor: Masayoshi Ohkoshi, Saitama, Japan

[73] Assignee: Diesel Kiki Co., Ltd., Tokyo, Japan

[21] Appl. No.: 904,002

[22] Filed: Sep. 4, 1986

[30] Foreign Application Priority Data

Sep. 10, 1985 [JP] Japan ..... 60-198577

[51] Int. Cl.[4] ..... F02D 1/04

[52] U.S. Cl. ..... 123/366; 123/367; 123/374

[58] Field of Search ..... 123/365, 366, 373, 374, 123/179 L

[56] References Cited

U.S. PATENT DOCUMENTS

| | | | |
|---|---|---|---|
| 3,572,303 | 3/1971 | Becker et al. | 123/365 |
| 3,847,127 | 11/1974 | Staudt | 123/366 |
| 3,884,205 | 5/1975 | Staudt et al. | 123/373 |
| 4,604,977 | 8/1986 | Ohnishi | 123/373 X |
| 4,612,890 | 9/1986 | Ohnishi | 123/373 |

FOREIGN PATENT DOCUMENTS

| | | | |
|---|---|---|---|
| 0840331 | 6/1952 | Fed. Rep. of Germany | 123/374 |
| 51-139818 | 11/1976 | Japan . | |
| 60-192239 | 12/1985 | Japan . | |
| 61-29032 | 2/1986 | Japan . | |
| 61-55138 | 4/1986 | Japan . | |

*Primary Examiner*—Tony M. Argenbright
*Assistant Examiner*—Eric R. Carlberg
*Attorney, Agent, or Firm*—Wenderoth, Lind & Ponack

[57] ABSTRACT

An injection quantity increasing mechanism for a governor in a fuel injection pump which is actuated at engine starting includes a guide lever and a torque cam both rotatable in accordance with the rpm of an engine, a floating lever swingably connected to the guide lever, a control lever for controlling the engine rpm and a control rack for controlling the fuel injection quantity both associated with the floating lever, and a stop device lever adapted to be displaced in a direction which decreases the fuel injection quantity and is associated with the control rack. This mechanism is characterized in that the control lever and the floating lever are swingably connected to each other by first and second supporting levers which are swingable relative to each other and in that the swinging motion of the first and second supporting levers offsets displacements from the control rack and from the guide lever exerted on the floating lever when the stop device lever performs its stop function to maintain the rotational position of the torque cam.

3 Claims, 4 Drawing Sheets

INJECTION QUANTITY INCREASING MECHANISM FOR GOVERNOR IN FUEL INJECTION PUMP AT ENGINE STARTING

BACKGROUND OF THE INVENTION

1. Field of the Invention

The present invention relates to an injection quantity increasing mechanism for a governor in a fuel injection pump which is actuated at engine starting to make it easy to start an engine at extremely low temperatures.

2. Description of the Related Art

There have heretofore been proposed various governors mounted on a fuel injection pump of a diesel engine and adapted to increase and decrease the fuel injection quantity, thereby adjusting the output. For example, Japanese Utility Model Public Disclosure No. SHO 51-139818 discloses a governor adapted to be mounted on a straight type fuel injection pump. This prior art governor is of a so-called mechanical type and can adjust the injection quantity by transmitting a lift displacement of a weight provided on a cam shaft of an injection pump under centrifugal force to one end of a floating lever via a tension lever and a guide lever and by further transmitting the lift displacement to a control rack coupled to the other end of the floating lever. With the prior art governor, the control rack can be displaced to a position over its full load position by setting a control lever at a full-speed position, moving the control rack in a direction which increases the injection quantity through the floating lever and causing one end of a sensor lever having the other end thereof connected to the control rack to engage in a notch portion formed in a torque cam. Thus, the injection quantity can be increased at engine starting.

However, with the prior art governor having such an injection quantity increasing mechanism actuated at engine starting, when a diesel engine or an injection pump is driven in a cold region, the viscosity of lubricating oil introduced into the governor is increased to prevent the aforementioned mechanism from being smoothly operated. For this reason, the desirability of improving the mechanism has found widespread acceptance. Such improvements are disclosed in Japanese Utility Model Public Disclosures No. SHO 60-192239, No. SHO 61-29032 and No. SHO 61-55138, for example. In these improvements, a torque cam is forcibly driven by an actuator using a solenoid or a shape memory effect alloy, or a weight is forcibly lifted by displacing a shifter pivotally attached to the lower end of a tension lever in a direction of the side of the weight, thereby facilitating the movement of the tension lever and a guide lever. However, these improvements require use of an actuator or another drive means for operating the torque cam or the shifter, which constitutes an additional part. Furthermore, the work of mounting the additional part is cumbersome. Furthermore, since this kind of mechanism has strict limitations on part dimensions, and it is very difficult to obtain mounting space for the aforementioned additional part from a standpoint of design considerations.

SUMMARY OF THE INVENTION

One object of the present invention is to provide an injection quantity increasing mechanism for a governor in a fuel injection pump which is actuated at engine starting that can solve the problems suffered by the conventional mechanisms and that can effect starting of an engine rapidly with exactitude even at extremely low temperatures.

Another object of the present invention is to provide an injection quantity increasing mechanism for a governor in a fuel injection pump which is actuated at engine starting and is capable of obtaining desired effects with a simple construction not requiring either the use of any additional part such as an actuator or any additional mounting space and is easy to manufacture.

To attain the objects described above, according to the present invention, there is provided an injection quantity increasing mechanism for a governor in a fuel injection pump which is actuated at engine starting, which mechanism comprises a guide lever and a torque cam both rotatable in accordance with the rpm of an engine, a floating lever swingably connected to the guide lever, a control lever for controlling the engine rpm and a control rack for controlling the fuel injection quantity both associated with the floating lever, and a stop device lever adapted to be displaced in a direction which decreases the fuel injection quantity and is associated with the control rack, and is characterized in that the control lever and the floating lever are swingably connected to each other with first and second supporting levers swingable relative to each other and in that the swinging motion of the first and second supporting levers offsets displacements from the control rack and from the guide lever exerted on the floating lever when the stop device lever performs its stop function to thereby hold the rotation of the torque cam constant. According to the present invention, there is further provided an injection quantity increasing mechanism for a governor in a fuel injection pump which is actuated at engine starting, which mechanism comprises a torque cam rotatable in accordance with the rpm of an engine, a control rack for controlling the fuel injection quantity, a stop device lever for displacing the control rack in a direction which decreases the fuel injection quantity, and a sensor lever engageable with and disengageable from the torque cam depending on the displacement of the control rack, and is characterized in that a push plate associated with a drive system for the torque cam is provided so as to be displaceable in the axial direction of the control rack and engageable with the stop device lever and in that a notch formed in the torque cam is located within a swivel area of an engaging portion of the sensor lever so as to be engageable with the engaging portion when the stop device lever performs its stop function.

The above and other objects, characteristic features and advantages of the present invention will become apparent to those skilled in the art as the disclosure is made in the following description of a preferred embodiment of the invention, as illustrated in the accompanying drawings.

DETAILED DESCRIPTION OF THE PREFERRED EMBODIMENT

Figure 1:
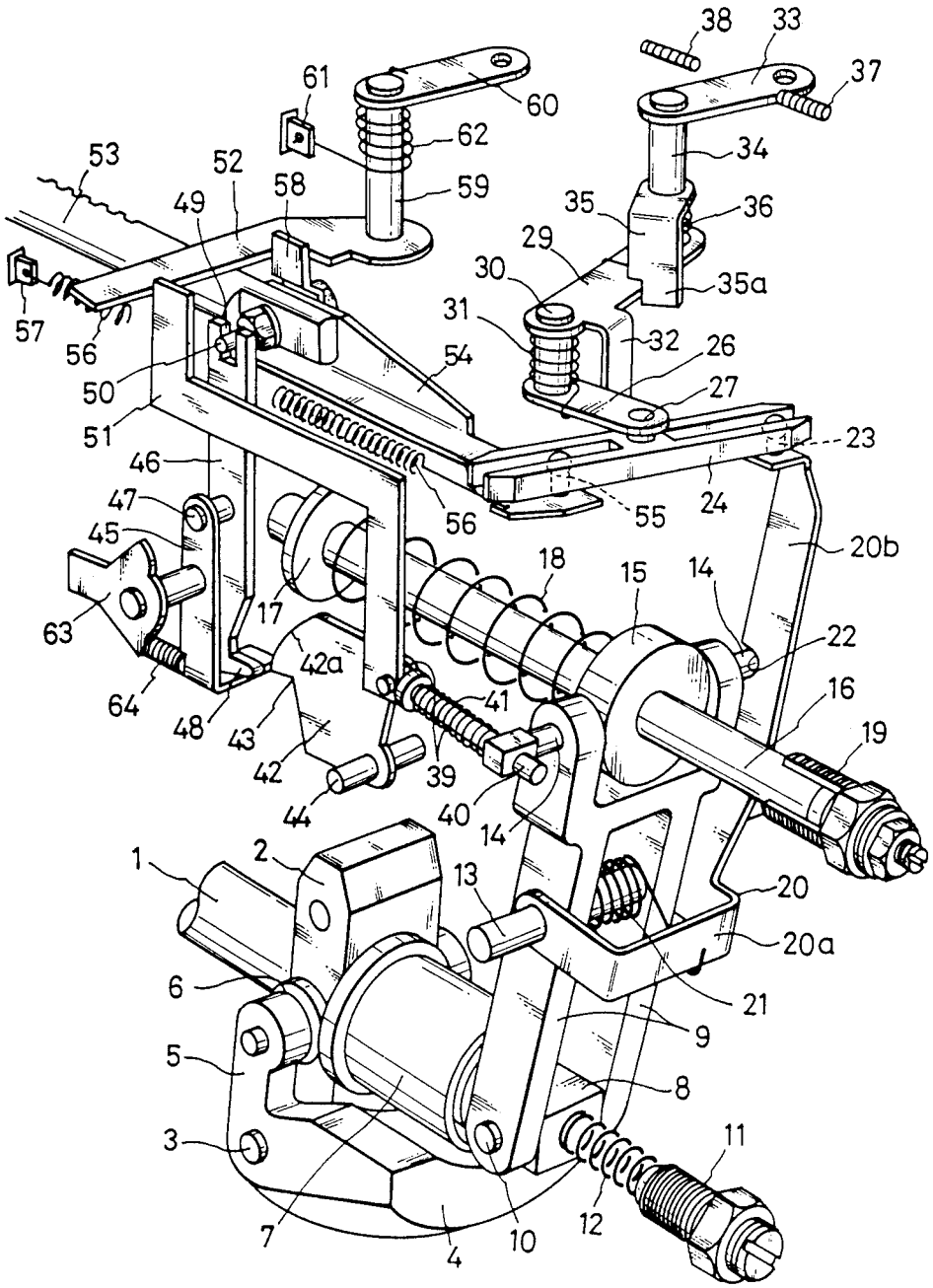
FIG. 1 is a perspective view illustrating one embodiment of the injection quantity increasing mechanism according to the present invention with the engine idle.

The present invention will now be described in detail with reference to the illustrated embodiment which is applied to a straight type fuel injection pump equipped with a mechanical governor.

With reference to FIG. 1 through FIG. 5, reference numeral 1 designates a cam shaft rotatably supported within a fuel injection pump and adapted to receive power transmitted by an engine drive shaft (not shown). The cam shaft 1 is provided integrally with a weight holder 2 which has a weight 4 pivotally attached thereto with a press-in pin 3 so that the weight 4 is rotatable about the press-in pin 3. The weight 4 has an arm 5 on which a slider 6 is rotatably supported about a pivot. Adjacent the slider 6 is a sleeve 7 having one end face engageable with the slider 6 so that the sleeve 7 can be moved in a direction that is coaxial with the axis of the cam shaft. A shifter 8 is connected to the other end face of the sleeve 7 through a bearing (not shown). The shifter 8 is pivotally attached to the lower ends of tension levers 9 by means of a pin 10 so that it can be moved in the same direction as the sleeve 7. A spring capsule 11 having an idle spring 12 imparts a biasing force to the shifter 8.

The tension levers 9 are rotatably supported at intermediate portions thereof by means of a tension lever shaft 13 of a governor cover (not shown). The upper end portions of the tension levers 9 support a spring seat 15 by means of pins 14. A governor shaft 16 is slidably inserted into the spring seat 15 at the center thereof and has another spring seat 17 fitted at an end thereof. Between the spring seats 15 and 17 there is a governor spring 18 extending around the governor shaft 16, which produces no biasing force under normal conditions. A guide screw 19 regulates the axial position of the governor shaft 16.

On the tension lever shaft 13 is rotatably supported one end of a guide lever 20 having a channel-shaped bent piece **20*a*. Both ends of a first cancel spring 21 are hooked respectively on one of the tension levers 9 and on the channel-shaped bent piece 20*a*. The restoring force of the first cancel spring 21 retains both the guide lever 20 and the tension levers 9 so that they can move together. The channel-shaped bent piece 20*a* has an elongate extension piece 20*b* rising from one side thereof. The extension piece 20*b* has a notch 22 formed in the intermediate portion thereof so that one of the pins 14 can be engaged therein, and is provided on an inwardly bent upper end thereof with an integral ball joint 23 to which one end of a floating lever 24** is connected.

The floating lever 24 is bifurcated at the opposite ends thereof and has a through hole 25 or groove formed in the central portion thereof. Within the through hole 25 of the floating lever 24 there is rotatably accommodated a pin 27 projecting from one end of a first supporting lever 26. The other end of the first supporting lever 26 is formed with a through hole 28 within which a pin 30 projecting from one end of a second supporting lever 29 is rotatably accommodated. Both ends of a second cancel spring 31 are hooked respectively on the first and second supporting levers 26 and 29 so that the first supporting lever 26 is movable with the pin 30 of the second supporting lever 29. The second supporting lever 29 has a bent lever 32 formed integrally with a side end portion thereof so as to be engageable with a side end portion of the first supporting lever 26. The other end of the second supporting lever 29 is formed with a through hole (not shown) into which a control lever shaft 34 integral with a control lever 33 interlocked with an accelerator pedal (not shown) is rotatably inserted. On the intermediate portion of the control lever shaft 34 there is mounted an L-shaped lever 35 having a lower engaging tongue piece **35*a* engageable with the side end portion of the second supporting lever 29. Both ends of a third cancel spring 36 are hooked respectively on the L-shaped lever 35 and the second supporting lever 29 so that the second supporting lever 29 is movable with the control lever shaft 34. Denoted by 37 and 38 are an idle setting bolt and a full-speed setting bolt respectively. These bolts 37 and 38 are located within a swivel area of the control lever 33**.

On the end of the other of the pins 14 supporting the spring seat 15 therebetween there is supported a rod 39 with the effective length thereof being adjustable by an adjusting nut 40 and a screw (not shown). A spring 41 extends about the periphery of the rod 39 in a compressed state and has its restoring force acting on the upper end of a torque cam 42. The torque cam 42 is a plate having a special shape and has a substantially arcuate cam face **42*a* formed on the peripheral surface thereof and a notch 43 formed in the vicinity of the cam face 42*a* and is rotatably supported by a pin 44 integral with the governor cover and inserted through the end of the torque cam 42 that is opposite to the end side on which the cam face 42*a* and the notch 43** are formed.

At a position facing the cam face **42*a* of the torque cam 42 there is located one end of a U-shaped lever 45. A longitudinal sensor lever 46 is rotatably supported inside the U-shaped lever 45 by means of a pin 47 inserted into the other end of the U-shaped lever 45. The sensor lever 46 is provided on the lower end thereof with a hook-like engaging pawl 48 capable of engaging with the open edge of the notch 43 of the torque cam 42 and coming into close contact with the cam face 42*a*. The upper end of the sensor lever 46 is bifurcated to define an upwardly open groove 49 in which a bolt pin 50 is inserted and engaged. A substantially Z-shaped push plate 51 is movable in the same axial direction as the axial direction in which a control rack 53, which will be described afterwards, is moved. The Z-shaped push plate 51 has one end thereof fixed to the rod 39 connected to the upper end of the torque cam 42 and the other end thereof extending toward the movement area of a stop device lever 52. The push plate 51 may be fixed at one end thereof to any one of the torque cam 42, tension lever 9 and guide lever 20 constituting a drive system for the torque cam 42 in place of the rod 39**.

The aforementioned bolt pin 50 connects the control rack 53 and a rack connecting link 54 coaxially with each other. The leading end of the link 54 is stationarily provided with a ball joint 55 engaged in a groove defined by the bifurcated end of the floating lever 24. Between the leading end of the rack connecting link 54 and a spring eye 57 fixed to a governor housing (not shown) there is a start spring 56 which biases the control rack 53 in a direction which would increase the fuel injection quantity under normal conditions.

Inside the rack connecting link 54, a stop device plate 58 constituting a stop device is fixed at a position coaxial with the bolt pin 50. The stop device lever 52 is disposed so that it can engage the side edge portions of both the stop device plate 58 and the push plate 51. A stop lever shaft 59 is fixed to the base end portion of the stop device lever 52, and one end of a stop lever 60 is fixed to the stop lever shaft 59. Both ends of a return spring 62 are hooked respectively on the stop lever 60 and into a spring eye 61 fixed to the governor housing, thereby enabling the stop lever to return to the normal position, i.e. in a direction of counter-stop operation. Denoted by reference numerals 63 and 64 are a full-load setting lever and a full-load setting bolt, respectively.

Figure 2:
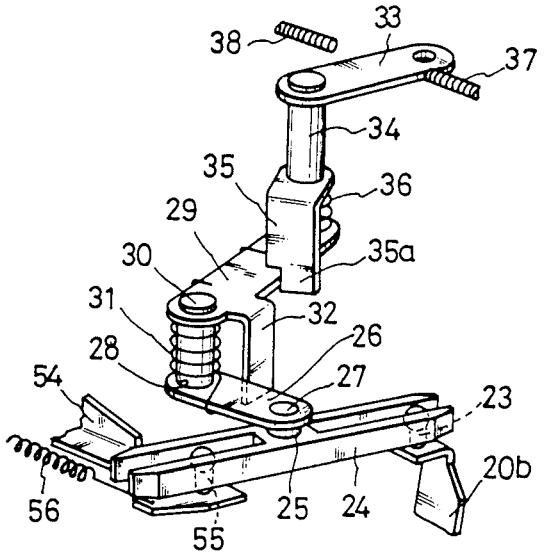
FIG. 2 is a perspective view illustrating a principal part of the embodiment.

In the mechanism for a governor having the aforementioned construction for increasing the fuel injection quantity at engine starting, during engine idling for example, the position of the control lever 33 interlocked with the accelerator pedal is set by the idle setting bolt 37 as illustrated in FIGS. 1 and 2. In this state, the first and second supporting levers 26 and 29 are rotated, with the displacement of the control lever shaft 34, by the second and third cancel springs 31 and 36 to return the pin 27 serving as a fulcrum of the floating lever 24 to an idle position. The idle control is effected in this way. That is to say, the tension lever 9 and guide lever 20 are displaced and the floating lever 24 and control rack 53 are displaced under the centrifugal force of the weight 4 based on the rotation of the cam shaft 1 being counterbalanced by the set restoring force of both the start spring 56 applying its biasing force to the control rack 53 and the idle spring 12, thereby retaining stable engine idle rpm.

Figure 3:
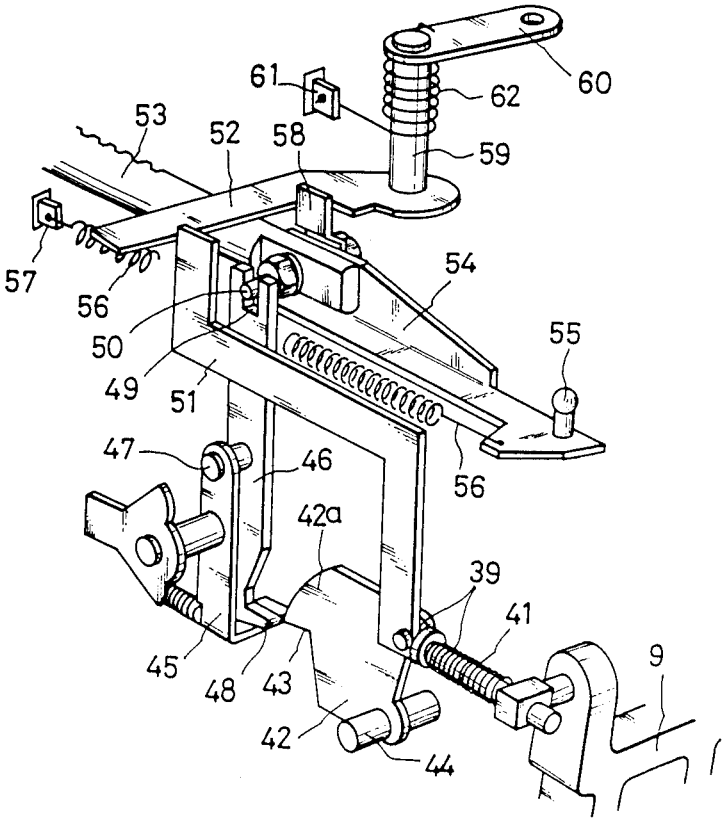
FIG. 3 is a perspective view illustrating another principal part of the embodiment.
Figure 4:
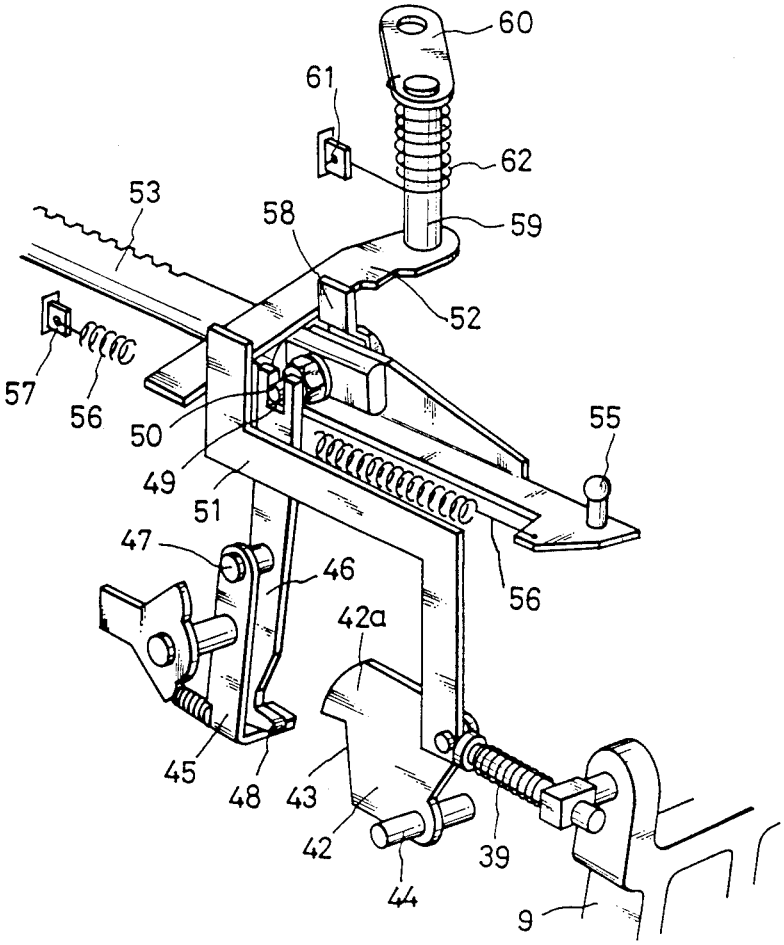
FIG. 4 is a perspective view illustrating the principal part of the embodiment with the engine stopped.

During engine idling, the floating lever 24 causes the control rack 53 to be displaced in the direction which decreases the fuel injection quantity via the first and second supporting levers 26 and 29 depending on the set position of the control lever 33. At this time, the sensor lever 46 engaged with the bolt pin 50 fixed to the control rack 53 is rotated, and the engaging claw 48 formed on the leading end of the sensor lever 46 is spaced apart from the torque cam 42. For this reason, the engaging claw 48 of the sensor lever 46 and the notch 43 of the torque cam 42 have a positional relationship at which they are incapable of engaging with each other as illustrated in FIG. 3. Further, in this case, the stop device is not actuated to locate the stop lever 60 at a normal position as illustrated in FIG. 3. The stop device lever 52 moving in conjunction with the stop lever 60 is held stationary at a prescribed position separated from the stop device plate 58 and also separated from the rising end of the push plate 51 substantially facing the stop device plate 58.

When the stop device is actuated to stop the engine under these circumstances, the stop lever 60 is rotated about the stop lever shaft 59 in the counterclockwise direction in FIG. 3 to rotate the stop device lever 52 integral with the stop lever shaft 59 in a direction against the biasing force of the return spring 62. As a result, the stop device lever 52 engages successively with the rising end of the push plate 51 falling within the swivel area of the stop device lever 51 and with the stop device lever 58.

When the push plate 51 engaged with the stop device lever 52 is pushed rightwards in FIG. 3, the rod 39 connected to the other end of the push plate 51 is displaced in a direction against the biasing force of the spring 41. The displacement of the rod 39 is transmitted to the tension lever 9, while the end of the torque cam 42 connected to the rod 39 is pulled in the same direction to rotate the torque cam 42 about the pin 44 in the clockwise direction in FIG. 3. As a result, the notch 43 formed in the peripheral surface of the torque cam 42 is displaced slightly upwards from its position shown in FIG. 3 to be located within the swivel area of the engaging pawl 48 formed on the sensor lever 46. In this case, the tension lever 9 is rotated about the tension lever shaft 13 in the clockwise direction in FIG. 1 with the displacement of the rod 39. The rotational displacement of the tension lever 9 is transmitted to the extension piece **20*b* of the guide lever 20 via the pin 14 to move the guide lever 20 through the first cancel spring 21 in conjunction with the tension lever 9. Consequently, the ball joint 23 fixed to the upper end of the extension piece 20*b* is moved rightwards in FIG. 1, with the result that one end of the floating lever 24 connected to the ball joint 23** is displaced in the same direction.

In the meantime, with the stop device plate 58 engaged with the stop device lever 52, the control rack 53 having the plate 58 fixed thereto is moved rightwards in FIG. 1, i.e. in a direction of decreasing the fuel injection quantity, against the biasing force of the start spring 56, thereby displacing the ball joint 55 provided on the leading end of the rack connecting link 54 in the same direction and also displacing the end of the floating lever 24 connected to the ball joint 55 in the same direction. For this reason, the biasing force of the second and third cancel springs 31 and 36 increased with the movement of the ball joint 23 is nullified. This means that the floating lever 24 has been substantially horizontally moved rightwards in FIG. 1 by an extent corresponding to the aforementioned displacement. In other words, the weight 4 is in a state in which its lift is zero. From this state, the guide lever 20, tension lever 9, rod 39 and weight 4 which participate in the drive of the floating lever 24 are successively displaced.

In this state, therefore, the spring 41 is stretched only by an amount corresponding to the aforementioned displacement, and the rod 39 connected to one end of the torque cam 42 is retained at a position substantially the same as the position held after the movement of the push plate 51. Therefore, the rotation displacement of the torque cam 42 is maintained similarly to the aforementioned displacement and the position of the notch 43 is fixed within the swivel area of the engaging pawl 48.

In this kind of mechanism having a prior art stop device, when the stop lever 60 has been set on a stop side, the floating lever 24 is caused to slightly rotate about the pin 27 in the counterclockwise direction in FIG. 1, with the movement of the control rack 53 in the direction which decreases the fuel injection quantity, in the state of incompletely cancelling the displacement or action given to the floating lever 24, and both the guide lever 20 and the tension lever 9 are inclined in front by an angle corresponding to the rotation of the floating lever 24. Thus, the weight 4 is set in a small lift state. The torque cam 42 is caused to rotate in the counterclockwise direction in FIG. 1 by an amount corresponding to the lift, thereby locating the notch 43 in the swivel area of the engaging pawl 48. In this way, a problem of failing to smoothly engage the engaging pawl 48 and the notch 43 with each other at engine starting and the problem of failing to rapidly start the engine can be solved.

In the meantime, when the control rack 53 is pulled in the direction of decreasing the injection quantity, the bolt pin 50 provided on the control rack 53 is moved in the same direction. As a result, the sensor lever 46 is rotated about the pin 47 in a clockwise direction as shown in FIG. 3 to space the engaging pawl 48 thereof apart from the torque cam 42, thereby assuming the state shown in FIG. 4. However, this state brings about no obstacle to rapid engagement between the engaging pawl 48 and the notch 43 at engine starting because the position of the notch 43 is held intact.

When the engine stopped in the manner described above is started, the stop lever 60 of the stop device is operated to swivel from the stop position to the normal position. This operation can be accomplished by operating the stop device and then releasing the stop lever 60, thereby allowing the stop lever 60 and stop device lever 52 to returned to the normal position by means of the return spring 62. This operation does not change state assumed by the torque cam 42. To be specific, although the stop device lever 52 is disengaged from the push plate 51 by rotating the stop device lever 52 toward the normal position, since the push plate 51 has no such special means as means for restoring it to the original position, the aforementioned disengagement neither moves the push plate 51 nor causes the torque cam 42 to follow the push plate 51. In addition, since the weight 4 has not yet assumed a lift state at the time of engine starting, there is no possibility of the torque cam 42 being displaced through the tension lever 9 and rod 39 which are displaced in accordance with the lift of the weight 4. Therefore, the torque cam 42 is held in the state shown in FIG. 4.

Figure 5:
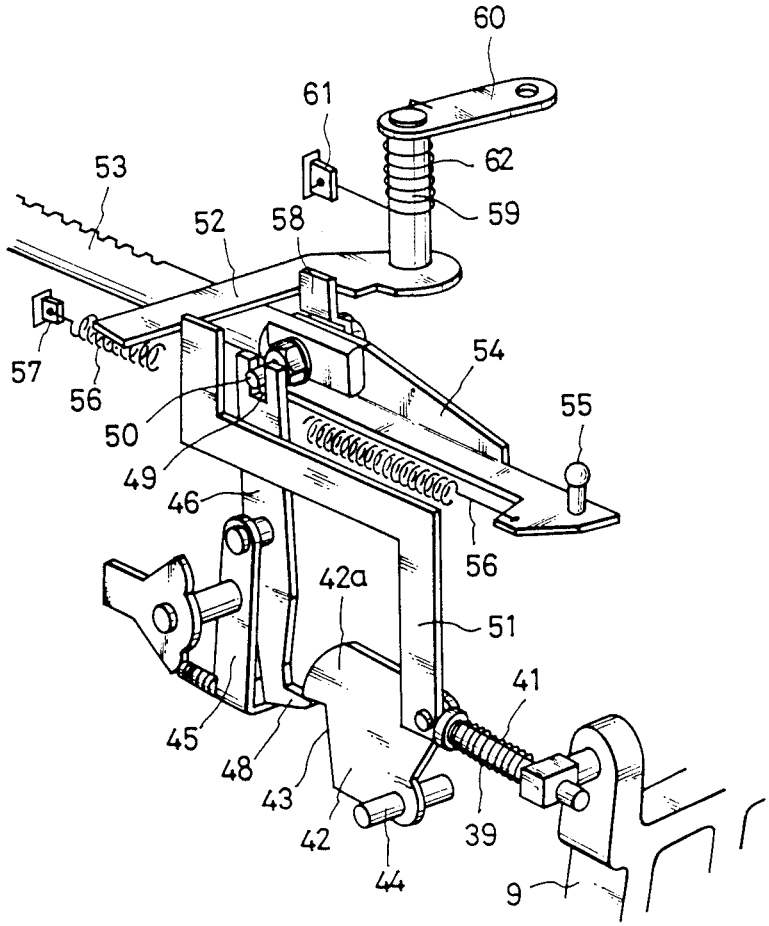
FIG. 5 is a perspective view illustrating the principal part of the embodiment with the engine starting.

When the accelerator pedal is depressed to the fullest extent in the aforementioned state and the control lever 33 is set at the full-speed setting bolt 38, the L-shaped lever 35 fixed to the control lever shaft 34 is rotated in the counterclockwise direction in FIG. 2 together with the shaft 34. With this rotational displacement, the second supporting lever 29 is displaced through the medium of the third cancel spring 36 to the right in FIG. 2. The displacement of the second supporting lever 29 is transmitted to the first supporting lever 26 through the second cancel spring 31. Therefore, the lever 26 is pulled to the left in FIG. 2. As a result, the floating lever 24 is rotated about the ball joint 23 in the clockwise direction in FIG. 2. The rotational displacement of the floating lever 24 is transmitted to the ball joint 55 and then to the rack connecting link 54. Therefore, the control rack 53 connected to the link 54 is moved to the left in FIG. 4, i.e. in the direction of increasing the fuel injection quantity. With the movement of the control rack 53, the bolt pin 50 projecting from the rack 53 is moved to rotate the sensor lever 46 about the pin 47 in the counterclockwise direction in FIG. 4. As a result, the engaging claw 48 formed on the lower end of the sensor lever 46 enters the notch 43 of the torque cam held in a standby position within the swivel area of the engaging claw 48, as illustrated in FIG. 5.

In this case, therefore, the counterclockwise rotation of the sensor lever 46 is increased by an amount corresponding to the displacement of the engaging claw 48 into the notch 43 to thereby enable the control rack 53 to be moved to a position corresponding to a full load position in the direction of increasing the fuel injection quantity. Thus, an increase in injection quantity at engine starting is facilitated and the engine can easily be started rapidly. This is very advantageous for an engine driven in a cold region where the viscosity of lubricating oil is liable to increase.

After the starting of the engine, the control lever 33 is operated until it collides with the idle setting bolt 37. As a result, the control rack 53 is pulled to the right in FIG. 5, i.e. in the direction of decreasing the injection quantity, through the first and second supporting levers 26 and 29 and the floating lever 24. And, the sensor lever 46 is rotated to space the engaging claw 48 from the notch 43. Subsequent operation of the control lever 33 does not bring about an increase in injection quantity.

As described above, the injection quantity increasing mechanism according to the present invention comprises a guide lever and a torque cam both rotatable in accordance with the rpm of an engine, a floating lever swingably connected to the guide lever, a control lever for controlling the engine rpm and a control rack for controlling the fuel injection quantity both associated with the floating lever, and a stop device lever adapted to be displaced in a direction of decreasing the fuel injection quantity and associated with the control rack, and has a construction such that the control lever and the floating lever are swingably connected to each other with first and second supporting levers swingable relative to each other and that the swing motion of the first and second supporting levers offsets displacements from the control rack and from the guide lever exerted on the floating lever when the stop device lever performs its stop function to thereby hold the rotation of the torque cam constant. Therefore, the torque cam and the sensor lever can smoothly be engaged with each other even when the engine, after being stopped, is started. Thus, the injection quantity increasing mechanism can be rapidly actuated with exactitude to facilitate the increase in injection quantity at engine starting. The prior art drawbacks of deviating the position of the torque cam at the stop operation, bringing about unstable engagement between the torque cam and the sensor lever and preventing the starting operation from being effected rapidly can be eliminated.

Furthermore, the injection quantity increasing mechanism according to the present invention comprises a torque cam rotatable in accordance with the rpm of an engine, a control rack for controlling the fuel injection quantity, a stop device lever for displacing the control rack in a direction of decreasing the fuel injection quantity, and a sensor lever engageable with and disengageable from the torque cam depending on the displacement of the control rack, and has a construction such that a push plate associated with a drive system for the torque cam is provided so as to be displaceable in the axial direction of the control rack and engageable with the stop device lever and that a notch formed in the torque cam is located within a swivel area of an engaging portion of the sensor lever so as to be engageable with the engaging portion when the stop device lever performs its stop function. Thus, an increase in injection quantity can be attained by immediately engaging the torque cam and the sensor lever. Therefore, the mechanism of the present invention can advantageously be used in a cold region where the viscosity of lubricating oil for use in a fuel injection pump is liable to be increased. Furthermore, according to the present invention, desired effects can be obtained merely by slightly modifying an existing apparatus having a stop device lever. Therefore, the mechanism of the present invention is simple in construction and easy to manufacture, and can solve the prior art problems caused by the use of an additional part such as the difficulty in obtaining mounting space for the additional part.

What is claimed is:

1. An injection increasing mechanism of a governor in a fuel injection pump of an engine for increasing the quantity of fuel injection during starting of the engine, said mechanism comprising:

tension lever means pivotally supported in the governor, said tension lever means operatively connected to an output shaft of the engine for pivoting over a rotational amount corresponding to the rpm output by the engine;

a torque cam pivotally supported in the governor, said torque cam having a notch extending therein;

a rod extending between and operatively connecting said tension lever means and said torque cam;

a guide lever connected to said tension lever means for pivoting with the tension lever means;

a floating lever having first and second ends, the first end of the floating lever rotatably mounted to the guide lever;

a control rack movable in first and second directions, the control rack for increasing the quantity of fuel injected by the fuel injection pump when moved in said first direction and for decreasing the quantity of fuel injected by the fuel injection pump when moved in said second direction, the control rack having a rack connecting link means movable therewith in said directions, and a bolt pin projecting therefrom, the second end of said floating lever rotatably mounted to said rack connecting link means;

a displaceable control lever for controlling the rpm output by the engine;

a first supporting lever pivotally mounted to said floating lever between the first and second ends thereof;

a second supporting lever pivotally mounted to and extending between said first supporting lever and said control lever;

a first cancel spring operatively connected between the first and the second supporting levers for causing the first supporting lever to move in conjunction with said second supporting lever, and a second cancel spring operatively connected between said second lever and said control lever for causing said second supporting lever to move in conjunction with said control lever, the displacement of said control lever being transmitted to said first supporting lever through said second supporting lever;

a movable stop lever, and a stop device lever means movable with said stop lever in a predetermined direction for performing a stopping operation, a sensor lever having first and second ends and pivotally supported between the first and the second ends thereof in the governor, the first end of the sensor lever engaged with the bolt pin of said control rack, and the second end of the sensor lever comprising an engaging portion for engaging and disengaging with the notch extending in said torque cam; and a push plate having one end thereof engageable with said stop device lever means so as to be movable therewith when the stop device lever means is moved in the predetermined direction, the other end of the push plate engaged with said torque cam so as to pivot the torque cam when moved by the stop device lever means.

2. An injection increasing mechanism as claimed in claim 1, and further comprising a stop device plate projecting from said rack connecting link means and engageable with said stop device lever means for engaging said stop device lever means when said stop device lever means is moved in said predetermined direction to move said control rack in said second direction while said push plate is moved.

3. In an injection quantity increasing mechanism in a governor for a fuel injection pump comprising a control rack movable in a first direction to decrease the quantity of fuel injected by the fuel injection pump, a movable stop device lever for performing a stop operation, the stop device lever operatively connected to the control rack and movable in a predetermined direction to move the control rack in said first direction to perform said stop operation, a sensor lever engaging the control rack so as to be displaced thereby when the control rack is moved in said first direction, the sensor lever having an engaging portion, and a rotatable torque cam having a notch engageable with the engaging portion of said sensor lever, the engaging portion movable along a predetermined path during the displacement of the sensor lever to engage said notch, the improvement comprising:

a push plate means extending between said stop device lever and said torque cam, the push plate means engageable with said stop device lever so as to be displaceable thereby when said stop device lever is moved in the predetermined direction, and the push plate means operatively connected to said torque cam for pivoting said torque cam to a predetermined position when displaced by said stop device lever performing the stop operation, said predetermined position being located along said path.

* * * * *